US012654964B2

(12) United States Patent
Chen et al.

(10) Patent No.: US 12,654,964 B2
(45) Date of Patent: Jun. 16, 2026

(54) PAPER FEEDING MECHANISM AND PRINTING EQUIPMENT

(71) Applicant: Guangzhou Luxvisions Innovation Technology Limited, Guangdong City (CN)

(72) Inventors: Hsin-Chang Chen, Guangzhou City (CN); Chun-Tseng Hung, Guangzhou City (CN); Jen-Chieh Liu, Guangzhou City (CN); Ta-Yi Lee, Guangzhou City (CN)

(73) Assignee: GUANGZHOU LUXVISIONS INNOVATION TECHNOLOGY LIMITED, Guangzhou City (CN)

( * ) Notice: Subject to any disclaimer, the term of this patent is extended or adjusted under 35 U.S.C. 154(b) by 42 days.

(21) Appl. No.: 18/766,339

(22) Filed: Jul. 8, 2024

(65) Prior Publication Data

US 2025/0153962 A1 May 15, 2025

(30) Foreign Application Priority Data

Nov. 14, 2023 (CN) ..... 202311519259.2

(51) Int. Cl.
*B65H 1/04* (2006.01)
*B65H 1/14* (2006.01)

(52) U.S. Cl.
CPC ..... *B65H 1/04* (2013.01); *B65H 1/14* (2013.01); *B65H 2403/46* (2013.01); *B65H 2405/1117* (2013.01); *B65H 2405/35* (2013.01)

(58) Field of Classification Search
CPC ... B65H 1/04; B65H 1/08; B65H 1/12; B65H 1/14; B65H 2403/46; B65H 2405/1117; B65H 2405/3321; B65H 2405/35; B65H 2405/353; B65H 2405/354
See application file for complete search history.

(56) References Cited

U.S. PATENT DOCUMENTS

2006/0180994 A1* 8/2006 Jang ..... B65H 3/0638 271/147
2009/0267283 A1* 10/2009 Mizuguchi ..... G03G 15/6514 271/3.14
2015/0061214 A1* 3/2015 Woo ..... B65H 3/0607 271/160
2016/0122140 A1* 5/2016 Furusawa ..... B65H 1/12 271/147

* cited by examiner

*Primary Examiner* — Prasad V Gokhale
(74) *Attorney, Agent, or Firm* — Davis Wright Tremaine LLP

(57) ABSTRACT

A paper feeding mechanism and a printing equipment are disclosed. The paper feeding mechanism includes a main body, a paper feeding component and a limiting component, where the paper feeding component includes a paper feeding tray and a paper lifting tray, the paper feeding tray and the main body are surrounded to form a paper storage cavity and the paper feeding tray is rotatably connected with the main body, the paper lifting tray rotates away from the paper feeding tray and drive a guide rod to move away from the paper feeding tray, the limiting component includes a limiting member and a driving component, the limiting member abuts against the guide rod to resist the paper lifting tray rotating away from the paper feeding tray.

18 Claims, 10 Drawing Sheets

PAPER FEEDING MECHANISM AND PRINTING EQUIPMENT

CROSS-REFERENCE TO RELATED APPLICATIONS

The present application claims priority to Chinese patent application No. 202311519259.2 filed Nov. 14, 2023, the content of which is incorporated herein by reference in its entirety.

FIELD OF THE INVENTION

The present invention relates to the technical field of paper transmission, in particular to a paper feeding mechanism and a printing equipment.

BACKGROUND OF THE INVENTION

In the prior art, a paper lifting tray of a paper feeding mechanism can adjust an inclination angle thereof according to a condition of paper. In the prior art, a height of one end of the paper lifting tray is usually limited by a way that a limiting component abuts against a guide rod of the paper lifting tray, in order to adjust the inclination angle of the paper lifting tray. However, when a user lifts up a paper feeding tray to take paper, the guide rod of the related paper feeding mechanism is easy to be dislocated, thus releasing a control of the limiting component on the paper lifting tray, which makes it difficult to reposition the paper lifting tray.

SUMMARY OF THE INVENTION

The present invention is intended to solve at least one of technical problems existing in the prior art. Therefore, the present invention provides a paper feeding mechanism and a printing equipment which can reposition a dislocated guide rod.

According to a first aspect of the present invention, a paper feeding mechanism may include: a main body, a paper feeding component and a limiting component. The paper feeding component is arranged on a side of the main body and includes a paper feeding tray and a paper lifting tray. The paper feeding tray and the main body are surrounded to form a paper storage cavity and the paper feeding tray is rotatably connected with the main body. One end of the paper lifting tray is rotatably connected with the paper feeding tray, and other end of the paper lifting tray has a guide rod slidably connected with the paper feeding tray. The paper lifting tray rotates away from the paper feeding tray and drive the guide rod to move away from the paper feeding tray. The limiting component is connected with the main body, and includes a limiting member and a driving component. The limiting member abuts against the guide rod to resist the paper lifting tray rotating away from the paper feeding tray. When the paper feeding tray rotates away from the main body, the guide rod disengaged from the limiting member and moves to a side of the limiting member away from the paper feeding tray, the driving component drives the limiting member to rotate to a side of the guide rod away from the paper feeding tray to make the limiting member abut against the guide rod, and the driving component drives the limiting member to drive the guide rod to move towards the paper feeding tray thereby driving the paper lifting tray to move towards the paper feeding tray.

The paper feeding mechanism according to embodiments of the present invention at least has the following beneficial effects.

In the embodiments of the present invention, the paper feeding component is arranged on the side of the main body, the paper storage cavity is formed between the paper feeding tray and the main body, and the paper feeding tray is rotatably connected with the main body, so that a user can lift up the paper feeding tray to take paper more conveniently and quickly. The limiting member is arranged to abut against the guide rod to resist the paper lifting tray rotating away from the paper feeding tray, so that a control on an inclination angle of the paper lifting tray is realized, and the controllability of the paper lifting tray is improved. The driving component is arranged such that when a user lifts up a paper feeding tray to take paper, which leads to a dislocation of the guide rod, the driving component can drive the limiting member to rotate to the side of the guide rod away from the paper feeding tray to make the limiting member abut against the guide rod, so that the limiting member can be repositioned in a position to limit the guide rod, and the guide rod is under control of the limiting member again. After the limiting member abuts against the guide rod again, the driving component can drive the limiting member to move the guide rod towards the paper feeding tray to drive the paper lifting tray to rotate towards the paper feeding tray, thereby realizing an automatic reposition of the paper lifting tray, which not only reduces a risk of failure of the paper feeding mechanism, but also reduces a need for manual intervention, improves the reliability and the stability of the paper feeding mechanism, and brings better user experience.

According to some embodiments of the present invention, the limiting member includes a swinging portion and a rotating portion which are rotatably connected. When the limiting member is located between the guide rod and the paper feeding tray, the swinging portion swings towards the guide rod, one end of the guide rod towards the paper feeding tray abuts against the rotating portion, the rotating portion rotates around the swinging member, and the swinging portion drives the rotating portion to move to the side of the guide rod away from the paper feeding tray and abut against one end of the guide rod away from the paper feeding tray.

According to some embodiments of the present invention, the limiting component includes a repositioning member. One end of the repositioning member is connected with the swinging portion, and other end of the repositioning member is connected with the rotating portion. The swinging portion drives the rotating portion to move from a side of the guide rod towards the paper feeding tray to the side of the guide rod away from the paper feeding tray, and the repositioning member drives the rotating portion to rotate away from the guide rod for reposition.

According to some embodiments of the present invention, the paper feeding mechanism includes a sensor which is arranged on the main body. The sensor is triggered when the paper feeding tray rotates away from the main body, and the sensor triggers the driving component to drive the limiting member to rotate.

According to some embodiments of the present invention, the main body includes a base which is arranged under the paper feeding tray and a mounting base which is arranged above the base and located on a side of the paper feeding component. The base and the paper feeding tray are surrounded to form the paper storage cavity. The mounting base is rotatably connected with the paper feeding tray and has a first guiding groove, and the paper feeding tray has a guiding member slidably connected with the first guiding groove.

According to some embodiments of the present invention, the limiting component is installed on the mounting base, and the driving component includes a driver, a worm, a worm wheel and a transmission component. One end of the worm is connected with the driver, and other end of the worm is connected with the worm wheel. One end of the transmission component is connected with the worm wheel, and other end of the transmission component is connected with the limiting member.

According to some embodiments of the present invention, the paper feeding tray has a second guiding groove arranged at one end of the paper feeding tray far away from a rotating connection position of the paper feeding tray and the paper lifting tray, and the guide rod is slidably connected with the second guiding groove.

According to some embodiments of the present invention, the paper feeding mechanism includes an elastic member arranged between the paper feeding tray and the paper lifting tray, and the elastic member drives the paper lifting tray to rotate away from the paper feeding tray.

According to some embodiments of the present invention, two opposite ends of the paper lifting tray respectively have a connecting portion extending outward therefrom, the paper feeding tray has a groove corresponding to a respective connecting portion, and the connecting portion inserts into a respective groove and rotates relative to the respective groove.

According to a second aspect of the present invention, there is provided a printing equipment including the paper feeding mechanism disclosed in the first aspect of the present invention.

Additional aspects and advantages of the present invention will be set forth in part in the following description and in part will be obvious from the following description, or may be learned by practice of the present invention.

BRIEF DESCRIPTION OF THE DRAWINGS

The present invention is further described with reference to the accompany drawings and embodiments, in which.

Figure 1:
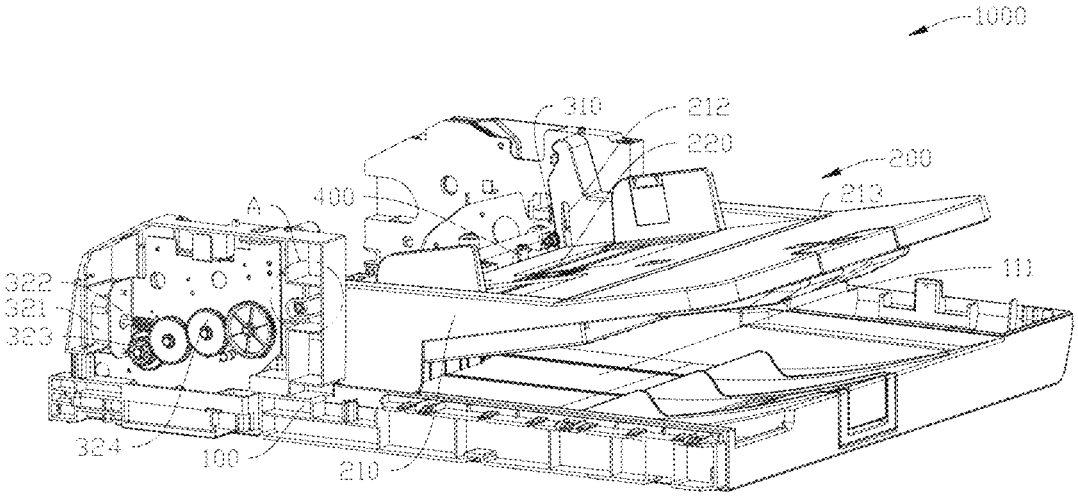
FIG. 1 is a schematic view of a paper feeding mechanism according to an embodiment of the present invention.

Reference numbers are as follows:

paper feeding mechanism: 1000;

main body: 100; base: 110; paper storage cavity: 111; mounting base: 120; first guiding groove: 121; mounting groove: 122;

paper feeding component: 200; paper feeding tray: 210; guiding member: 211; second guiding groove: 212; groove: 213;

paper lifting tray: 220; guide rod: 221; connecting portion: 222;

limiting component: 300; limiting member: 310; swinging portion: 311; rotating portion: 312;

driving component: 320; driver: 321; worm: 322; worm wheel: 323; transmission component: 324;

repositioning member: 330; connecting rod: 340;

sensor: 400; and elastic member: 500.

DETAILED DESCRIPTION OF THE EMBODIMENTS

Embodiments of the present invention are described in detail below, examples of which are shown in the accompanying drawings, where identical or similar labels from beginning to end indicate identical or similar elements or elements having identical or similar functions. The embodiments described below with reference to the accompanying drawings are illustrative and are intended only to explain the present invention and are not to be construed as limiting the present invention.

In the description of the present invention, it should be understood that descriptions related to orientations, such as terms indicating orientations or positional relationships like up, down, inside, outside, etc., are based on the orientations or positional relationships shown in the drawings, which are only for convenience and simplification of the description of the present invention, but not for the purpose of indicating or implying that the referred device or element must have a specific orientation, be constructed and operated in a specific orientation, and thus should not be construed as limiting the present invention.

In the description of the present invention, if there are descriptions to first and second, it is only for distinguishing technical features, they are not interpreted as indicating or implying relative importance or implicitly indicating the numbers of indicated technical features or implicitly indicating the precedence of the indicated technical features.

In the description of the present invention, unless otherwise specifically limited, terms such as arrange, mount, connect and the like should be understood in a broad sense, and those skilled in the art can reasonably determine the specific meanings of the above terms in the present invention by combining the specific contents of the technical schemes.

In related technology, a paper lifting tray of a paper feeding mechanism can adjust an inclination angle thereof according to a condition of paper. In the prior art, a height of one end of the paper lifting tray is usually limited by a way that a limiting component abuts against a guide rod of the paper lifting tray, in order to adjust the inclination angle of the paper lifting tray. A paper feeding tray and the paper lifting tray can feed paper for a printing equipment, and the printing equipment can store the paper in a paper storage cavity under the paper feeding tray after completing a printing of the paper. In order to facilitate a user to take paper, the paper feeding tray can be lifted up to provide the user with a wider view and a larger space for taking paper. However, when the user lifts up the paper feeding tray to take paper, the guide rod of the related paper feeding mechanism is easy to be dislocated, so that a control of the limiting component on the paper lifting tray is released, and the paper lifting tray is difficult to be repositioned.

Therefore, some embodiments of the present invention provide a paper feeding mechanism 1000, particularly referring to FIGS. 1 to 10 of the accompany drawings.

Figure 2:
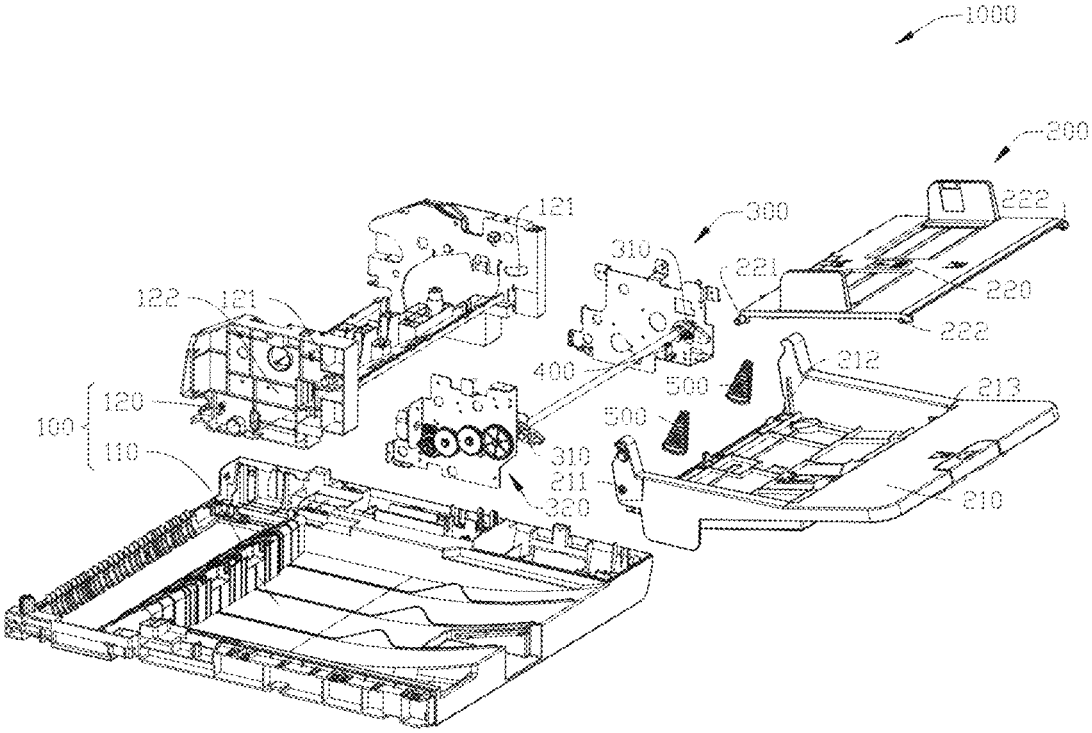
FIG. 2 is an exploded view of a paper feeding mechanism according to an embodiment of the present invention.
Figure 3:
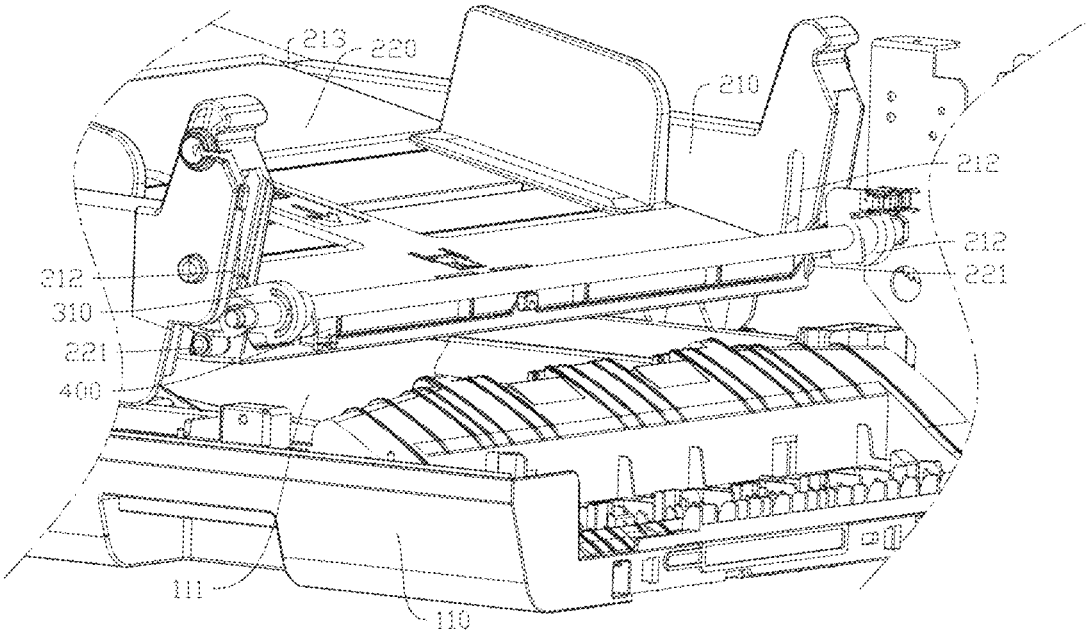
FIG. 3 is a partial schematic view of a paper feeding mechanism according to an embodiment of the present invention.
Figure 4:
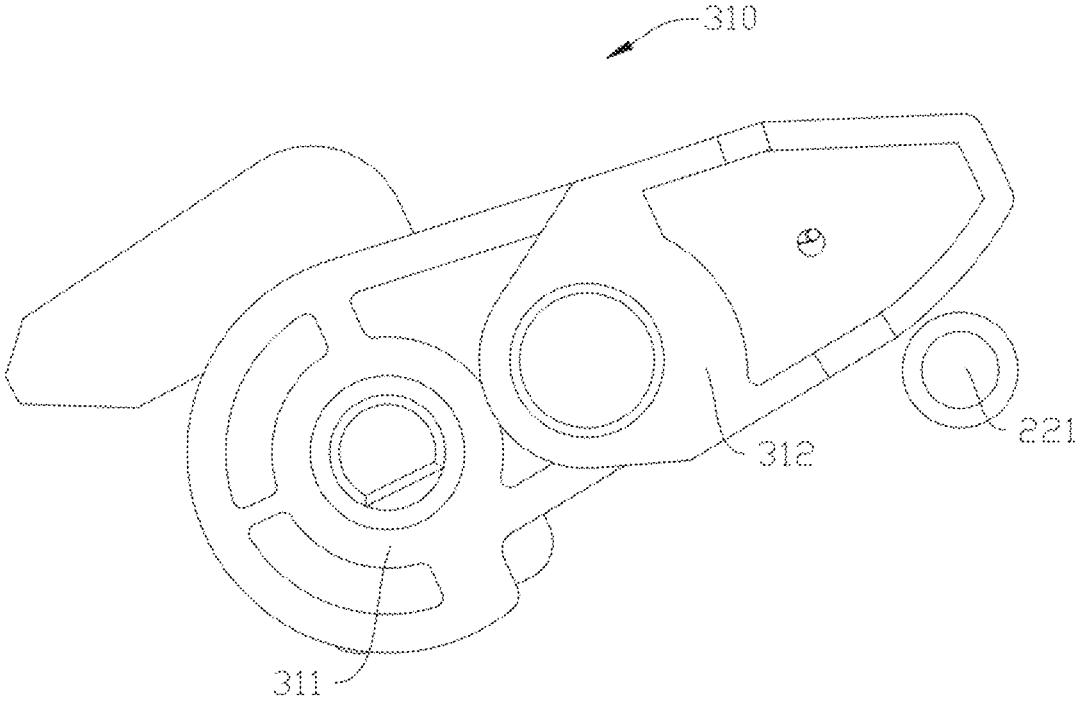
FIG. 4 is a schematic view of a first state of a limiting member and a guide rod in an embodiment of a paper feeding mechanism of the present invention.

Referring to FIGS. 1, 2, and 3, a paper feeding mechanism 1000 in an embodiment of the present invention can be applied to a printing equipment, and specifically, the paper feeding mechanism 1000 can feed paper for the printing equipment. The paper feeding mechanism 1000 includes: a main body 100, a paper feeding component 200, and a limiting component 300. The paper feeding component 200 is arranged at a side of the main body 100. Specifically, the paper feeding component 200 includes a paper feeding tray 210 apart from the main body 100, and a paper lifting tray 220 so that the paper feeding tray 210 and the main body 100 are surrounded to form a paper storage cavity 111. It should be understood that the printing equipment may receive paper fed by the paper feeding component 200 and complete a printing, and send out the paper after completing the printing, and the sent out paper can be temporarily stored in the paper storage cavity 111 to wait for taking by the user.

It should be noted that, since the paper feeding tray is located at the side of the main body, the paper feeding tray may cause a certain obstacle when a user takes the paper in the paper storage cavity, which may cause an inconvenience to the user. Based on this, referring to FIGS. 1, 2 and 3, in an embodiment of the present invention, the paper feeding tray 210 is rotatably connected with the main body 100. Specifically, the paper feeding tray 210 rotates towards or away from the main body 100. When a user takes paper, the user may lift up the paper feeding tray 210 to drive the paper feeding tray 210 to rotate away from the main body 100 to obtain a wider view and a larger space for taking paper, and when the user finishes taking paper, the user may put down the paper feeding tray 210 to drive the paper feeding tray 210 to rotate towards the main body 100 to reposition the paper feeding tray 210.

In order to enable the paper feeding mechanism 1000 to adjust paper feeding strength according to a condition of paper, referring to FIGS. 1, 2 and 3, in an embodiment of the present invention, the paper lifting tray 220 may be rotatably connected with the paper feeding tray 210 so that an inclination angle of the paper lifting tray 220 is adjusted according to the condition of paper, thereby adjusting a paper feeding strength. It should be noted that, the condition of paper may include paper specification, paper material, paper quantity, etc., which is not limited in the embodiments. Specifically, the paper feeding tray 210 may have a recessed position adapted to fit the paper lifting tray 220, and the paper lifting tray 220 may be arranged in the recessed position. One end of the paper lift tray 220 is rotatably connected with the paper feeding tray 210, and other end of the paper lift tray 220 has a guide rod 221 slidably connected with the paper feeding tray 210. The paper lifting tray 220 rotates away from the paper feeding tray 210 and drive the guide rod 221 to move away from the paper feeding tray 210. It is understood that the paper lifting tray 220 may keep a tendency to rotate away from the paper feeding tray 210, that is, the guide rod 221 may always keep a tendency to move away from the paper feeding tray 210. In an embodiment of the present invention, an elastic member 500 may be arranged between the paper lifting tray 220 and the paper feeding tray 210, the elastic member 500 may drive the paper lifting tray 220 to rotate away from the paper feeding tray 210, and the paper lifting tray 220 may also be driven to rotate by a driving device, which is not limited in the embodiments.

In order to limit the inclination angle of the paper lifting tray 220, referring to FIGS. 1, 2 and 3, in an embodiment of the present invention, a limiting component 300 is connected with the main body 100, and includes a limiting member 310 and a driving component 320. The limiting member 310 abuts against the guide rod 221 to resist the paper lifting tray 220 rotating away from the paper feeding tray 210. Specifically, referring to FIG. 4, when the limiting member 310 is in a first state, the limiting member 310 may be located on a side of the guide rod 221 away from the paper feeding tray 210, and the limiting member 310 abuts against one end of the guide rod 221 away from the paper feeding tray 210 and applies a pressure to the guide rod 221 towards the paper feeding tray 210 to offset a potential energy of the paper lifting tray 220 rotating away from the paper feeding tray 210, thereby limiting an inclination angle of the paper feeding tray 210.

Figure 5:
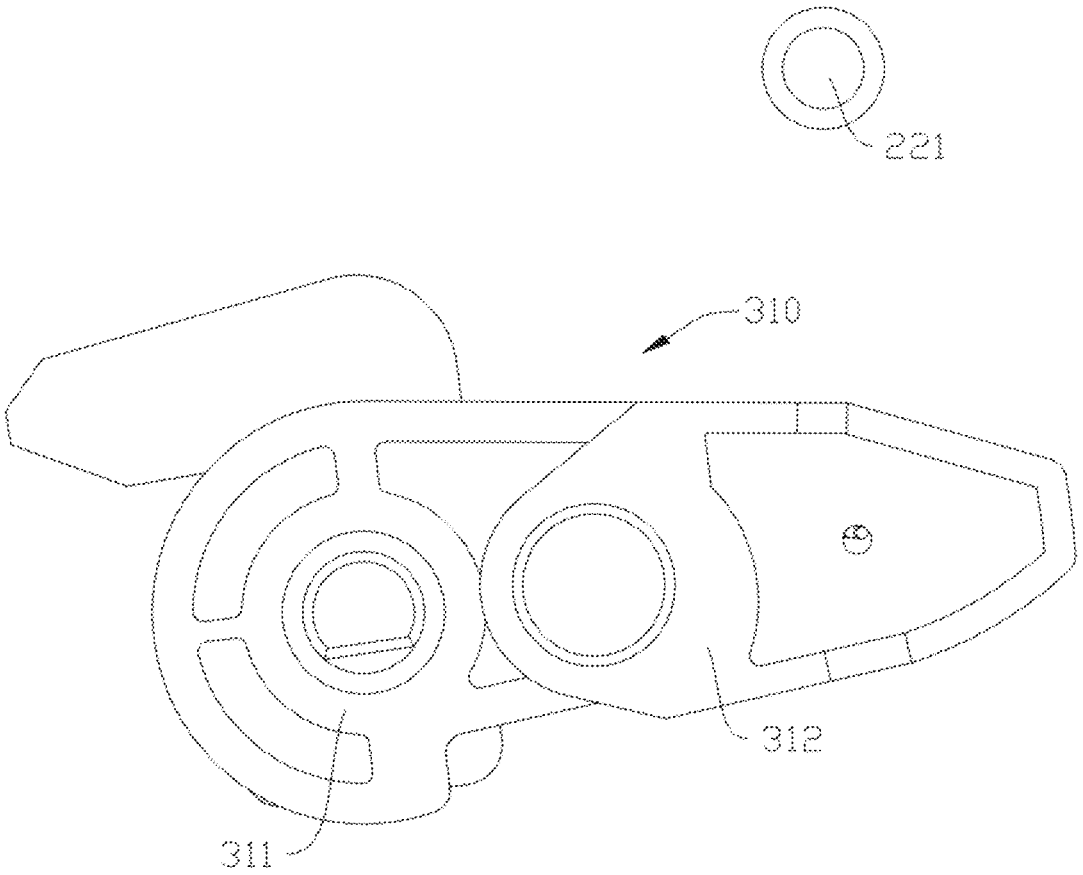
FIG. 5 is a schematic view of a second state of the limiting member and the guide rod in the embodiment of a paper feeding mechanism of the present invention.

It can be understood that the guide rod 221 and the limiting member 310 are not fixedly connected, so there is a possibility that the guide rod 221, driven by the paper lifting tray 220 or the paper feeding tray 210, disengages from the limiting member 310. After the guide rod 221 disengages from the limiting member 310, the limiting member 310 loses an ability to limit the guide rod 221. Referring to FIG. 5, at this time, the guide rod 221 may drive the paper lifting tray 220 to rotate away from the paper feeding tray 210, and the guide rod 221 moves to the side away from the paper feeding tray 210. Therefore, the limiting member 310 releases restriction on the guide rod 221, thus the limiting member 310 and the guide rod 221 are in a second state.

Figure 7:
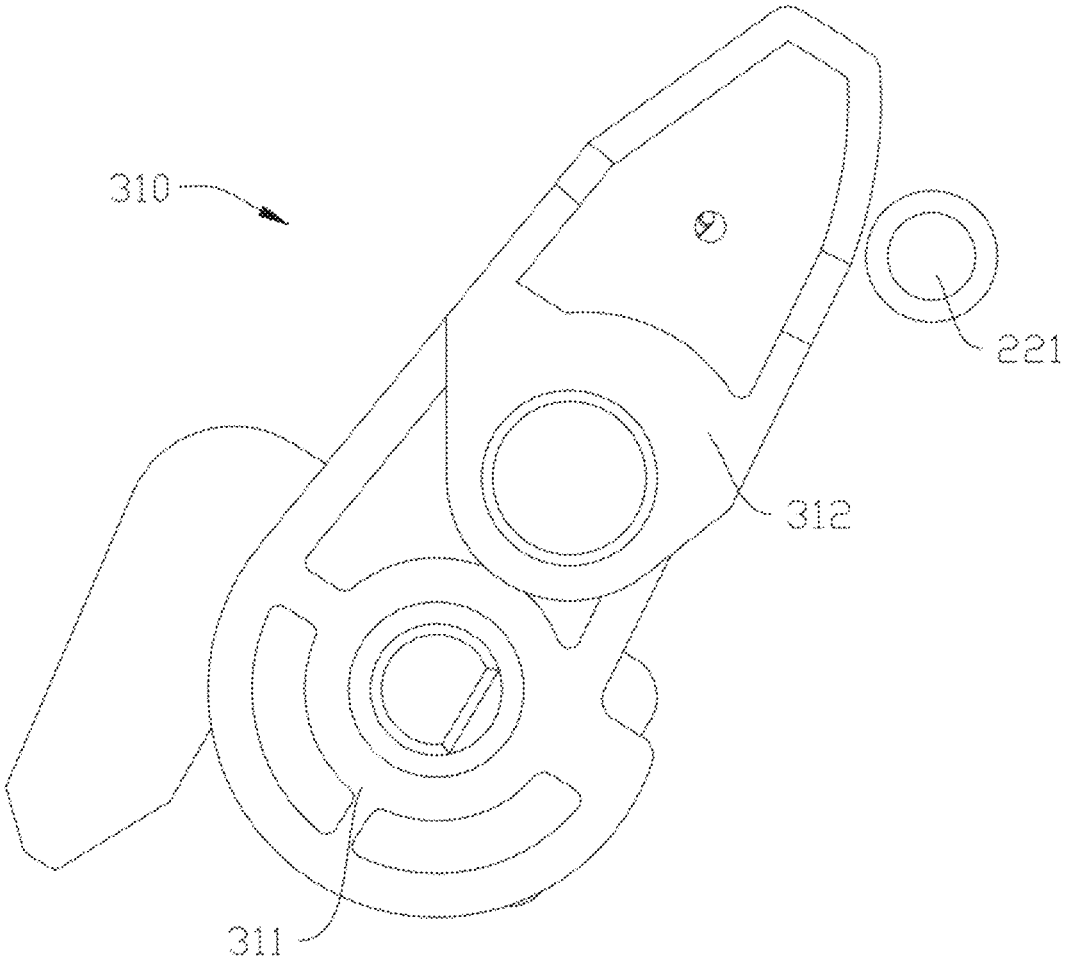
FIG. 7 is a schematic view of a fourth state of the limiting member and the guide rod in the embodiment of a paper feeding mechanism of the present invention.

Based on this, in order to enable the limiting member 310 to be repositioned in a position to limit the guide rod 221 and drive the guide rod 221 to be repositioned, as shown in FIGS. 5 and 7, in an embodiment of the present invention, when the paper feeding tray 210 rotates away from the main body 100, the guide rod 221 disengages from the limiting member 310 and moves to a side of the limiting member 310 away from the paper feeding tray 210, that is, the limiting member 310 and the guide rod 221 are in the second state. Then, the driving component 320 drives the limiting member 310 to rotate to the side of the guide rod 221 away from the paper feeding tray 210 to make the limiting member 310 abut against the guide rod 221. At this time, the limiting member 310 is in a fourth state. It should be noted that, as shown in FIG. 7, in an embodiment of the present invention, the limiting member 310 may rotate clockwise, thereby rotating to the side of the guide rod 221 away from the paper feeding tray 210, or may rotate counterclockwise, and after passing over the guide rod 221, rotate to the side of the guide rod 221 away from the paper feeding tray 210, which is not limited in the embodiments. In order to reposition the guide rod 221 and the paper lifting tray 220, in an embodiment of the present invention, the driving component 320 further drives the limiting member 310 to drive the guide rod 221 to move toward the paper feeding tray 210, thereby driving the paper lifting tray 220 to rotate towards the paper feeding tray 210, thus realizing reposition of the guide rod 221 and the paper lifting tray 220, and restoring the guide rod 221 and the limiting member 310 from the fourth state to the first state.

In the embodiments of the present invention, the paper feeding component 200 is arranged on the side of the main body 100, so that the paper storage cavity 111 is formed between the paper feeding tray 210 and the main body 100, and the paper feeding tray 210 is rotatably connected with the main body 100. Therefore, a user can lift up the paper feeding tray 210 to take paper more conveniently and quickly. The limiting member 310 is arranged to abut against the guide rod 221 to resist the paper lifting tray 220 rotating away from the paper feeding tray 210, thereby realizing a control of the inclination angle of the paper lifting tray 220, and improving the controllability of the paper lifting tray 220. Furthermore, the driving component 320 is arranged such that when the user lifts up the paper feeding tray 210 which causes the guide rod 221 to be dislocated, the driving component 320 can drive the limiting member 310 to rotate to the side of the guide rod 221 away from the paper feeding tray 210 to make the limiting member 310 abut against the guide rod 221, so that the limiting member 310 can be repositioned in the position to limit the guide rod 221, and the guide rod 221 is under control of the limiting member 310 again. After the limiting member 310 abuts against the guide rod 221 again, the driving component 320 can drive the limiting member 310 to drive the guide rod 221 to move towards the paper feeding tray 210, thereby driving the paper lifting tray 220 to rotate towards the paper feeding tray 210, thus realizing automatic reposition of the paper lifting tray 220, which reduces a risk of failure of the paper feeding mechanism 1000, reduces a requirement of manual intervention, improves the reliability and the stability of the paper feeding mechanism 1000, and brings better use experience.

Figure 10:
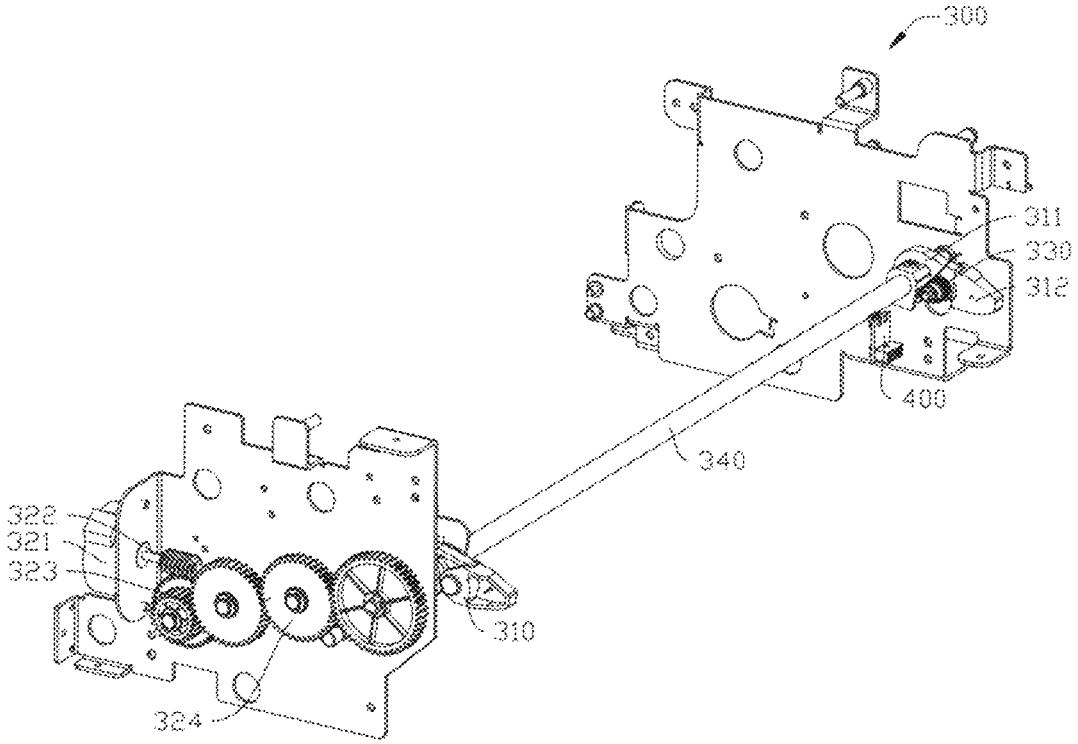
FIG. 10 is a schematic view of a driving component in an embodiment of a paper feeding mechanism of the present invention.

Referring to FIGS. 2, 3 and 10, in an embodiment of the present invention, there may be two limiting members 310 arranged spaced apart and connected by a connecting rod 340, thereby realizing synchronous rotation of the two limiting members 310. The driving component 320 may be connected with the connecting rod 340 to drive the two limiting members 310 to rotate. Correspondingly, the guide rod 221 may insert into the paper lifting tray 220. Additionally, two ends of the guide rod 221 may protrude from two ends of the paper lifting tray 220, and the two limiting members 310 may abut against corresponding two end portions of the guide rod 221, so that the two ends of the guide rod 221 and the two ends of the paper lifting tray 220 are stressed averagely, which reduces a risk of fracture of the guide rod 221 caused by stress concentration, and improves the stability of the paper lifting tray 220.

Figure 6:
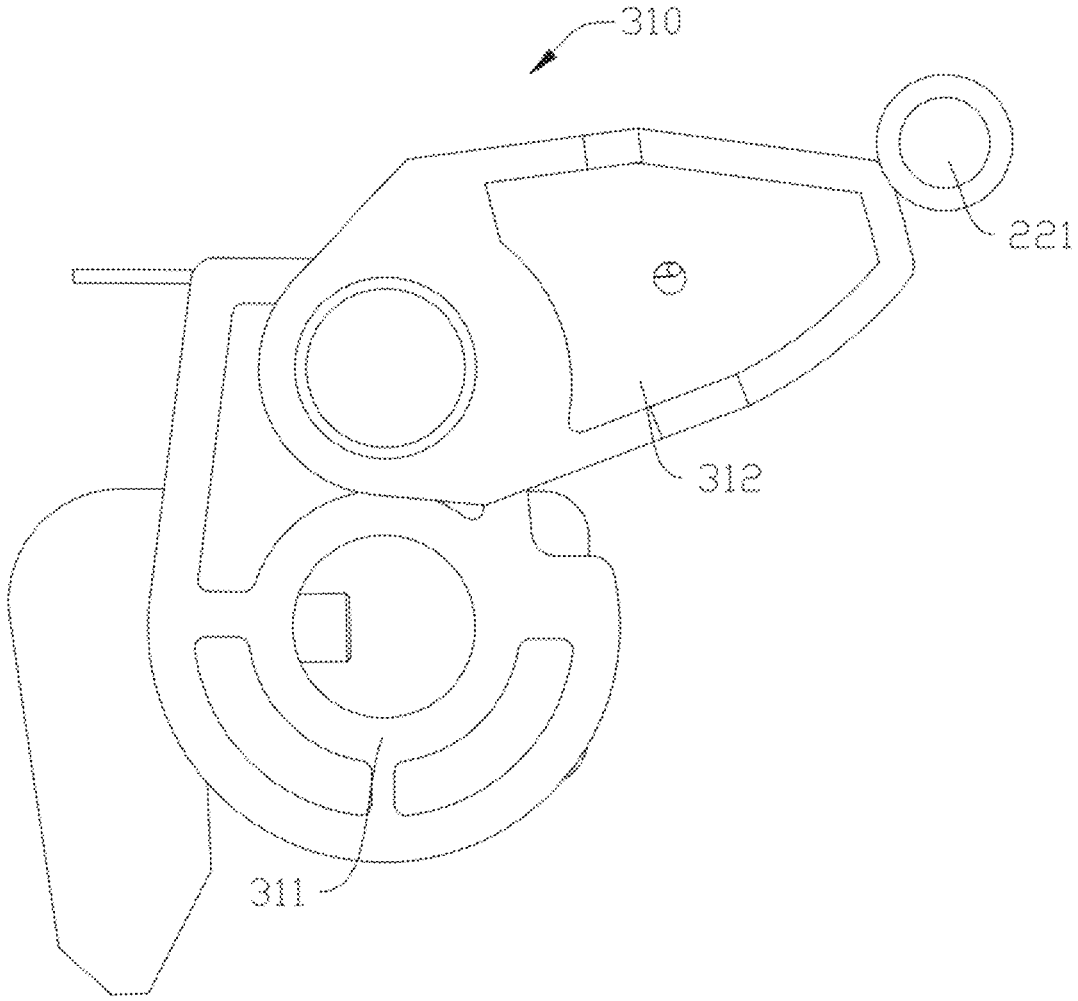
FIG. 6 is a schematic view of a third state of the limiting member and the guide rod in the embodiment of a paper feeding mechanism of the present invention.

Referring to FIGS. 2, 3 and 6, in an embodiment of the present invention, the limiting member 310 may include a swinging portion 311 and a rotating portion 312. The swinging portion 311 and a rotating portion 312 may be rotatably connected, and the swinging portion 311 may also be rotatably connected with the main body 100. In the embodiment, when the limiting member 310 is located between the guide rod 221 and the paper feeding tray 210, the limiting member 310 and the guide rod 221 are in the second state. In order to enable the limiting member 310 to be repositioned in the position to limit the guide rod 221, the swinging portion 311 swings toward the guide rod 221. When one end of the guide rod 221 towards the paper feeding tray 210 abuts against the rotating portion 312, the rotating portion 312 is unable to continue to rotate along with the swinging portion 311. Then, the rotating portion 312 rotates around the swinging member under an action of the guide rod 221, so that the limiting member 310 as a whole is in a bent state, that is, the limiting member 310 and the guide rod 221 are in a third state. After being bent, the limiting member 310 can continue to rotate away from the paper feeding tray 210 and pass over the guide rod 221. Specifically, the swinging portion 311 drives the rotating portion 312 to move to the side of the guide rod 221 away from the paper feeding tray 210 to abut against the one end of the guide rod 221 away from the paper feeding tray 210, so that the limiting member 310 can be repositioned in the position to limit the guide rod 221. Therefore, a rotation stroke of the limiting member 310 is reduced, the rotation time of the limiting member 310 is shortened, and the efficiency of the limiting component 300 for repositioning the paper lifting tray 220 is improved.

Figure 8:
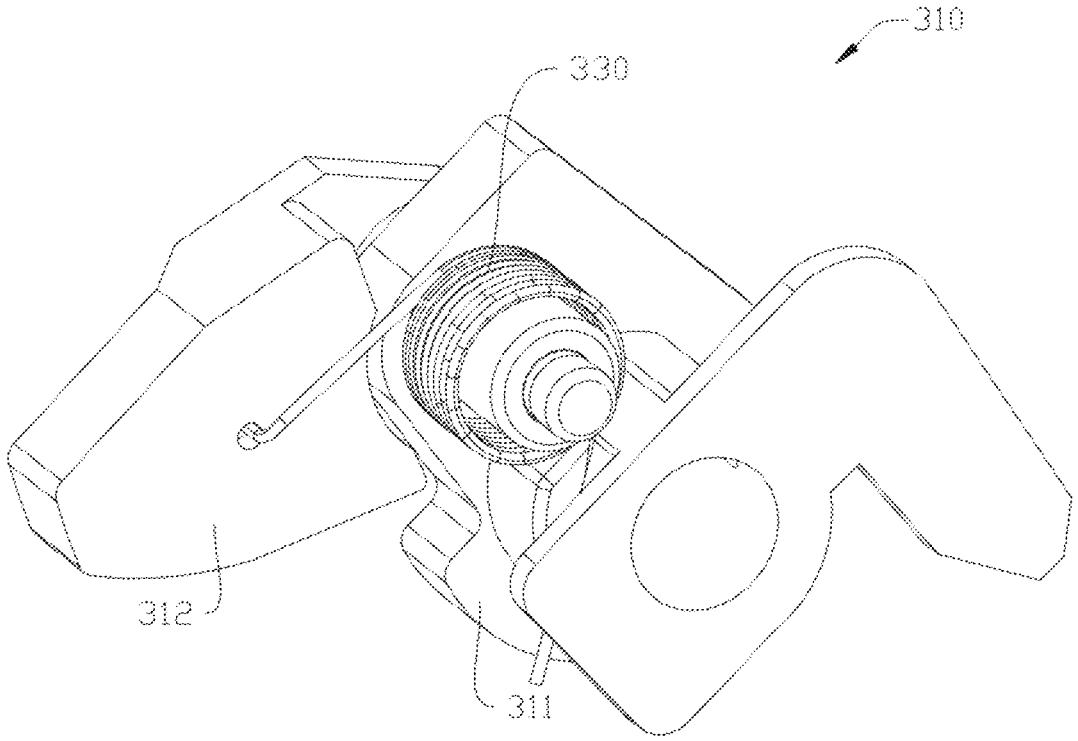
FIG. 8 is a schematic view of a limiting member in an embodiment of a paper feeding mechanism of the present invention.

Referring to FIGS. 2, 8 and 10, in an embodiment of the present invention, the limiting component 300 may include a repositioning member 330. One end of the repositioning member 330 is connected with the swinging portion 311, and another end of the repositioning member 330 is connected with the rotating portion 312. It should be noted that the repositioning member 330 may be a tension spring, and based on this, a relaxed state of the repositioning member 330 is a state in which the limiting member 310 as a whole is in a straight state, and when the rotating portion 312 rotates relative to the swinging portion 311, the repositioning member 330 is in a tight state. Accordingly, when the swinging portion 311 drives the rotating portion 312 to move from the side of the guide rod 221 towards the paper feeding tray 210 to the side of the guide rod 221 away from the paper feeding tray 210, the repositioning member 330 can drive the rotating portion 312 to rotate away from the guide rod 221 to be repositioned due to the rotating portion 312 losing a pressing force of the guide rod 221, so that the limiting member 310 is restored from the bent state to the straight state.

It is understood that when the paper feeding tray 210 rotates away from the main body 100, the paper feeding tray 210 drives the paper lifting tray 220 and the guide plate to move away from the limiting component 300, thereby disengaging the guide rod 221 from the limiting member 310. In order to know the dislocation of the guide rod 221 in time, referring to FIGS. 1, 2 and 3, in an embodiment of the present invention, the paper feeding mechanism 1000 may include a sensor 400 arranged on the main body 100. Specifically, the sensor 400 may be fixedly connected with the main body 100 and located on a side of the paper feeding component 200. It should be noted that the sensor 400 may detect whether the paper feeding tray 210 rotates relative to the main body 100. Based on this, the sensor 400 may be triggered when the paper feeding tray 210 rotates away from the main body 100, and the sensor 400 in turn triggers the driving member 320 to drive the limiting member 310 to rotate. That is, whether the guide rod 221 is dislocated may be confirmed by detecting whether the paper feeding tray 210 rotates away from the main body 100 by the sensor 400, or when the paper feeding tray 210 rotates away from the main body 100 and the paper feeding tray 210 rotates to a position where the guide rod 221 is dislocated, the sensor 400 is triggered, thereby confirming whether the guide rod 221 is dislocated. When the guide rod 221 is confirmed to be dislocated, the sensor 400 triggers the driving component 320 in time to drive the limiting member 310 to be repositioned in a position to limit the guide rod 221, which not only improves the efficiency of repositioning the guide rod 221, but also improves an automation degree of the paper feeding mechanism 1000, and reduces the requirement of manual intervention.

Figure 9:
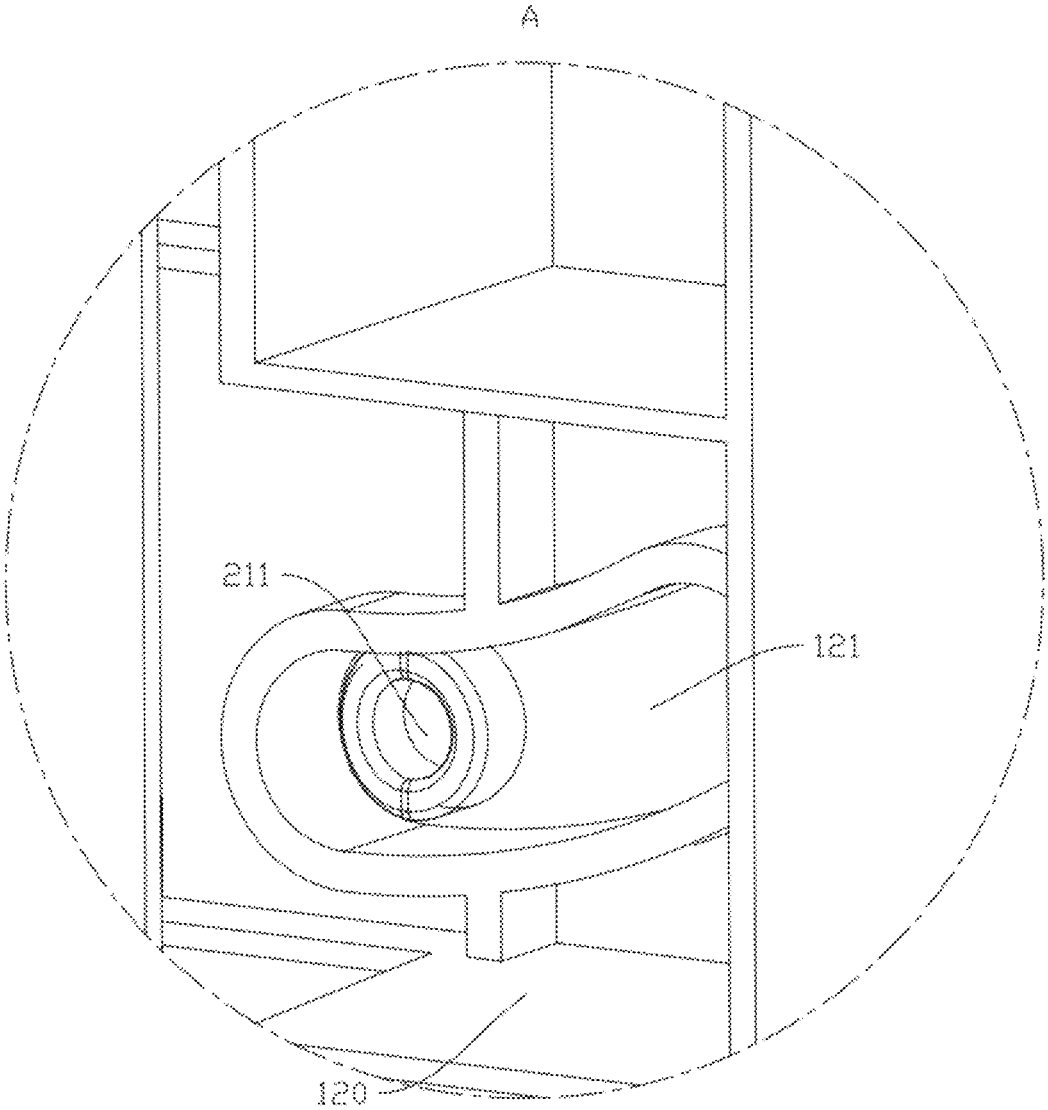
FIG. 9 is an enlarged view at A in FIG. 1.

Referring to FIGS. 1, 2 and 9, in an embodiment of the present invention, the main body 100 may include a base 110 and a mounting base 120. The base 110 may be arranged under the paper feeding tray 210. The base 110 and the paper feeding tray 210 are surrounded to form a paper storage cavity 111. The mounting base 120 may be arranged on above the base 110 and located on a side of the paper feeding component 200. The mounting base 120 may be integrally formed with the base 110, or the mounting base 120 and the base 110 may also be fixedly connected by a screw connection or a snap connection, which may be selected by a person having ordinary skill in the art according to actual situations and is not limited in the embodiments. The mounting base 120 may be rotatably connected with the paper feeding tray 210, that is, the paper feeding tray 210 may rotate around the mounting base 120 towards or away from the base 110. The mounting base 120 may have a first guiding groove 121, and the paper feeding tray 210 may have a guiding member 211 slidably connected with the first guiding groove 121. Specifically, the guiding member 211 may insert into the first guiding groove 121, and when the paper feeding tray 210 rotates around the mounting base 120 towards or away from the base 110, the guiding member 211 moves along the first guiding groove 121 under the driving of the paper feeding tray 210. It can be understood that the first guiding groove 121 restricts a movement of the guiding member 211, thereby guiding the rotation of the paper feeding tray 210, which improves a direction accuracy of the rotation of the paper feeding tray 210.

Referring to FIGS. 1, 2 and 10, in an embodiment of the present invention, a limiting component 300 may be installed on the mounting base 120. It is understood that the mounting base 120 may have a mounting groove 122 matching with the limiting component 300, and the driving component 320 may be fixedly connected in the mounting groove 122, thereby improving the integrity of the paper feeding mechanism 1000. It should be noted that the driving component 320 may be connected with the mounting base 120 through a screw or a snap, or may also be installed on the mounting base 120 through other forms of fixed connection manners, and a person having ordinary skill in the art may select the arrangement according to actual situations, which is not limited in the embodiments.

Referring to FIGS. 1, 2 and 10, in an embodiment of the present invention, the driving component 320 may include a driver 321, a worm 322, a worm wheel 323, and a transmission component 324. One end of the worm 322 is connected with the driver 321, and another end of the worm 322 is connected with the worm wheel 323. One end of the transmission component 324 is connected with the worm wheel 323, and other end of the transmission component 324 is connected with the limiting member 310. It should be understood that the driver 321 drives the worm wheel 323 to rotate through the worm 322, and the worm wheel 323 in turn drives the connecting rod 340 to rotate through the transmission component 324, thereby driving the limiting member 310. It should be noted that the worm wheel 323 and the worm 322 reduces the rotation speed of the driver 321 to a final rotation speed required by the driving component 320, and a driving component 320 with a larger torque can be obtained through a high reduction ratio. Based on this, the driving component 320 with high-speed reduction ratio can have a self-locking function, which reduces a risk of damage caused by a reverse rotation of the driver 321 due to maloperation of a user, and improves the safety and the reliability of the paper feeding mechanism 1000.

Referring to FIGS. 1, 2 and 3, in the embodiment of the present invention, a second guiding groove 212 may be arranged at a position of the paper feeding tray 210 corresponding to the guide rod 221, and the second guiding groove 212 may be arranged at an end of the paper feeding tray 210 away from a rotational connection position of the paper feeding tray 210 and the paper lifting tray 220. It should be noted that there may be two second guiding grooves 212 arranged at two ends of the paper feeding tray 210, respectively. The guide rod 221 may be slidably connected with the second guiding grooves 212. Specifically, each of the two ends of the guide rod 221 may insert into a correspond one of the two second guiding grooves 212, respectively, so that the second guiding groove 212 may play a role of guiding when the guide rod 221 moves away from the main body 100, which improves an accuracy of a moving direction of the guide rod 221 and an accuracy of a rotating direction of the paper lifting tray 220.

Referring to FIGS. 1 and 2, in an embodiment of the present invention, the paper feeding mechanism 1000 may include an elastic member 500 arranged between the paper feeding tray 210 and the paper lifting tray 220. The elastic member 500 drives the paper lifting tray 220 to rotate away from the paper feeding tray 210. It is understood that the elastic member 500 may serve as a power source for rotating the paper lifting tray 220 away from the paper feeding tray 210. Specifically, when the paper lifting tray 220 is at a lowest position, the elastic member 500 may be in a compressed state, and when a restriction of the guide rod 221 by the limiting member 310 is released, the elastic member 500 may gradually return from the compressed state to a relaxed state, thereby providing power for lifting the paper lifting tray 220.

Referring to FIGS. 1, 2 and 3, in the embodiment of the present invention, two opposite ends of the paper lifting tray 220 may respectively have a connecting portion 222 extending outward therefrom. The paper feeding tray 210 may have a groove 213 corresponding to a respective connecting portion 222, and the connecting portion 222 may insert into a respective groove 213 and may rotate relative to the respective groove 213. Specifically, there are two connecting portions 222, and correspondingly, there are two grooves 213. Each of the two connecting portions 222 is rotatably connected with a respective one of the two grooves 213, thereby realizing a rotating connection between the paper lifting tray 220 and the paper feeding tray 210, and enabling the paper lifting tray 220 to adjust the inclination angle thereof by lifting or lowering.

An embodiment of the present invention further provides a printing equipment including the paper feeding mechanism 1000 of the above embodiments.

Since the printing equipment adopts all technical schemes of the paper feeding mechanism 1000 of the above embodiments, at least all beneficial effects brought by the technical schemes of the above embodiments are achieved, and no further description is provided herein.

The embodiments of the present invention are described in detail above with reference to the accompanying drawings, and finally what should be explained is as follows: the above embodiments are only used for illustrating the technical schemes of the present invention, and not for limiting the same, and although the present invention is described in detail with reference to the foregoing embodiments, it should be understood by those of ordinary skill in the art that modifications may be made to the technical schemes described in the foregoing embodiments, or equivalents may be substituted for some or all of the technical features thereof, without departing from the scope of the embodiments of the present invention.

What is claimed is:

1. A paper feeding mechanism, comprising:

a main body;

a paper feeding component on a side of the main body, the paper feeding component comprising a paper feeding tray and a paper lifting tray, both of the paper feeding tray and the main body surround to form a paper storage cavity, the paper feeding tray rotatably connecting with the main body, one end of the paper lifting tray rotatably connecting with the paper feeding tray, another end of the paper lifting tray comprising a guide rod slidably connected with the paper feeding tray, and the paper lifting tray rotating away from the paper feeding tray to drive the guide rod to move away from the paper feeding tray;

a limiting component connected with the main body, the limiting component comprising a limiting member and a driving component, the limiting member abutting against the guide rod to resist the paper lifting tray rotating away from the paper feeding tray;

wherein, the guide rod disengages from the limiting member and moves to a side of the limiting member away from the paper feeding tray when the paper feeding tray rotates away from the main body, and the driving component drives the limiting member to rotate to a side of the guide rod away from the paper feeding tray to make the limiting member abut against the guide rod, and drives the limiting member to lead the guide rod to move towards the paper feeding tray, thereby driving the paper lifting tray to rotate towards the paper feeding tray.

2. The paper feeding mechanism according to claim 1, wherein the limiting member comprises a swinging portion and a rotating portion, both the swinging portion and the rotating portion are rotatably connected with each other, in response to the limiting member being located between the guide rod and the paper feeding tray, the swinging portion swings towards the guide rod, one end of the guide rod towards the paper feeding tray abuts against the rotating portion, the rotating portion rotates around the swinging member, and the swinging portion drives the rotating portion to move to a side of the guide rod away from the paper feeding tray and abut against one end of the guide rod away from the paper feeding tray.

3. The paper feeding mechanism according to claim 2, wherein the limiting component comprises a repositioning member, one end of the repositioning member is connected with the swinging portion, another end of the repositioning member is connected with the rotating portion, the swinging portion drives the rotating portion to move from a side of the guide rod towards the paper feeding tray to the side of the guide rod away from the paper feeding tray, and the repositioning member drives the rotating portion to rotate away from the guide rod for reposition.

4. The paper feeding mechanism according to claim 1, wherein the paper feeding mechanism comprises a sensor on the main body, the sensor is triggered in response to the paper feeding tray rotating away from the main body, and the sensor triggers the driving component to drive the limiting member to rotate.

5. The paper feeding mechanism according to claim 1, wherein the main body comprises a base arranged under the paper feeding tray, and a mounting base arranged above the base and located on a side of the paper feeding component, the base and the paper feeding tray are surrounded to form the paper storage cavity, the mounting base is rotatably connected with the paper feeding tray, the mounting base has a first guiding groove, and the paper feeding tray has a guiding member slidably connected with the first guiding groove.

6. The paper feeding mechanism according to claim 5, wherein the limiting component is installed on the mounting base, the driving component comprises a driver, a worm, a worm wheel and a transmission component, one end of the worm is connected with the driver, another end of the worm is connected with the worm wheel, one end of the transmission component is connected with the worm wheel, and another end of the transmission component is connected with the limiting member.

7. The paper feeding mechanism according to claim 1, wherein the paper feeding tray has a second guiding groove at one end of the paper feeding tray far away from a rotating connection position of the paper feeding tray and the paper lifting tray, and the guide rod is slidably connected with the second guiding groove.

8. The paper feeding mechanism according to claim 1, wherein the paper feeding mechanism comprises an elastic member between the paper feeding tray and the paper lifting tray, and the elastic member drives the paper lifting tray to rotate away from the paper feeding tray.

9. The paper feeding mechanism according to claim 1, wherein two opposite ends of the paper lifting tray respectively have a connecting portion extending outward therefrom, the paper feeding tray has a groove corresponding to a respective connecting portion, and the connecting portion is inserted into a respective groove to rotate relative to the respective groove.

10. A printing equipment comprising a paper feeding mechanism, the paper feeding mechanism comprising:

a main body;

a paper feeding component on a side of the main body, the paper feeding component comprising a paper feeding tray and a paper lifting tray, both of the paper feeding tray and the main body surround to form a paper storage cavity, the paper feeding tray rotatably connecting with the main body, one end of the paper lifting tray rotatably connecting with the paper feeding tray, another end of the paper lifting tray comprising a guide rod slidably connected with the paper feeding tray, and the paper lifting tray rotating away from the paper feeding tray to drive the guide rod to move away from the paper feeding tray;

a limiting component connected with the main body, the limiting component comprising a limiting member and a driving component, the limiting member abutting against the guide rod to resist the paper lifting tray rotating away from the paper feeding tray;

wherein, the guide rod disengages from the limiting member and moves to a side of the limiting member away from the paper feeding tray when the paper feeding tray rotates away from the main body, and the driving component drives the limiting member to rotate to a side of the guide rod away from the paper feeding tray to make the limiting member abut against the guide rod, and drives the limiting member to lead the guide rod to move towards the paper feeding tray, thereby driving the paper lifting tray to rotate towards the paper feeding tray.

11. The paper feeding mechanism according to claim 10, wherein the limiting member comprises a swinging portion and a rotating portion, both the swinging portion and the rotating portion are rotatably connected with each other, in response to the limiting member being located between the guide rod and the paper feeding tray, the swinging portion swings towards the guide rod, one end of the guide rod towards the paper feeding tray abuts against the rotating portion, the rotating portion rotates around the swinging member, and the swinging portion drives the rotating portion to move to a side of the guide rod away from the paper feeding tray and abut against one end of the guide rod away from the paper feeding tray.

12. The paper feeding mechanism according to claim 11, wherein the limiting component comprises a repositioning member, one end of the repositioning member is connected with the swinging portion, another end of the repositioning member is connected with the rotating portion, the swinging portion drives the rotating portion to move from a side of the guide rod towards the paper feeding tray to the side of the guide rod away from the paper feeding tray, and the repositioning member drives the rotating portion to rotate away from the guide rod for reposition.

13. The paper feeding mechanism according to claim 10, wherein the paper feeding mechanism comprises a sensor on the main body, the sensor is triggered in response to the paper feeding tray rotating away from the main body, and the sensor triggers the driving component to drive the limiting member to rotate.

14. The paper feeding mechanism according to claim 10, wherein the main body comprises a base arranged under the paper feeding tray, and a mounting base arranged above the base and located on a side of the paper feeding component, the base and the paper feeding tray are surrounded to form the paper storage cavity, the mounting base is rotatably connected with the paper feeding tray, the mounting base has a first guiding groove, and the paper feeding tray has a guiding member slidably connected with the first guiding groove.

15. The paper feeding mechanism according to claim 14, wherein the limiting component is installed on the mounting base, the driving component comprises a driver, a worm, a worm wheel and a transmission component, one end of the worm is connected with the driver, another end of the worm is connected with the worm wheel, one end of the transmission component is connected with the worm wheel, and another end of the transmission component is connected with the limiting member.

16. The paper feeding mechanism according to claim 10, wherein the paper feeding tray has a second guiding groove at one end of the paper feeding tray far away from a rotating connection position of the paper feeding tray and the paper lifting tray, and the guide rod is slidably connected with the second guiding groove.

17. The paper feeding mechanism according to claim 10, wherein the paper feeding mechanism comprises an elastic member between the paper feeding tray and the paper lifting tray, and the elastic member drives the paper lifting tray to rotate away from the paper feeding tray.

18. The paper feeding mechanism according to claim 10, wherein two opposite ends of the paper lifting tray respectively have a connecting portion extending outward therefrom, the paper feeding tray has a groove corresponding to a respective connecting portion, and the connecting portion is inserted into a respective groove to rotate relative to the respective groove.

* * * * *